US005580129A

United States Patent [19]

Findlay

[11] Patent Number: 5,580,129

[45] Date of Patent: Dec. 3, 1996

[54] PORTABLE FOLDING CHAIR

[76] Inventor: Robert Findlay, 790 Grove St., Glencoe, Ill. 60022

[21] Appl. No.: 470,632

[22] Filed: Jun. 6, 1995

Related U.S. Application Data

[63] Continuation-in-part of Ser. No. 421,546, Apr. 13, 1995.

[51] Int. Cl.[6] ..... A47C 3/18

[52] U.S. Cl. ..... 297/344.21; 297/344.26; 248/349.1

[58] Field of Search ..... 297/27, 28, 31, 297/35, 40, 344.21, 344.26, 354.13, 359, 440.24, 452.2; 248/345.1, 349.1, 408, 423, 502, 505

[56] References Cited

U.S. PATENT DOCUMENTS

| | | | |
|---|---|---|---|
| 2,243,190 | 5/1941 | Capaldo | 248/408 X |
| 2,528,950 | 11/1950 | Engsham | 297/344.26 X |
| 2,645,275 | 7/1953 | Wong | 297/360 |
| 2,708,962 | 5/1955 | Rechler | 297/31 |
| 3,496,950 | 2/1970 | Weber et al. | 248/408 X |
| 3,602,930 | 9/1971 | Channon | 9/347 |
| 3,713,445 | 1/1973 | Marsan | 128/283 |
| 3,902,496 | 9/1975 | Eakin | 128/283 |
| 4,277,115 | 7/1981 | Stuwe et al. | 308/26 |
| 4,445,898 | 5/1984 | Jensen | 604/337 |
| 4,482,184 | 11/1984 | Mincey | 297/28 |
| 4,867,505 | 9/1989 | Parker | 297/27 |
| 5,016,792 | 5/1991 | Jay | 297/129 X |
| 5,035,681 | 7/1991 | Hertel et al. | 474/152 |
| 5,256,298 | 10/1993 | Powell | 210/660 |
| 5,265,659 | 11/1993 | Pajtas et al. | 152/329 |
| 5,267,680 | 12/1993 | Torok | 297/183.1 X |
| 5,335,967 | 8/1994 | Vanderminden | 297/35 |
| 5,403,275 | 4/1995 | Phipps | 604/20 |

FOREIGN PATENT DOCUMENTS

| | | | |
|---|---|---|---|
| 4415933 | 11/1994 | Germany | 297/344.21 |

*Primary Examiner*—Peter R. Brown
*Attorney, Agent, or Firm*—Hamman & Benn

[57] ABSTRACT

A portable folding chair that is provided with a pair of telescoping side mounting members each made up of an inner and outer telescoping tube that are prevented from having sliding movement relative to each other when the chair is in its erected state, in order to stabilize the chair when sat upon. The outer tube constitutes the upper tube so that any sand or dirt entering into the interior of the telescoping members will fall right out again. The front support legs are sloped forwardly to allow for the chair to be more fully collapsed.

3 Claims, 6 Drawing Sheets

PORTABLE FOLDING CHAIR

CROSS REFERENCE TO RELATED APPLICATION

This application is a continuation-in-part of copending application Ser. No. 08/421,546, filed on Apr. 13, 1995.

BACKGROUND OF THE INVENTION

The present invention in directed to a portable folding chair, such as a beach chair. Specifically, the present invention is an improvement on the portable folding chair disclosed in U.S. Pat. No. 4,482,184—Mincey, which patent is incorporated by reference herein.

The portable folding chair disclosed in U.S. Pat. No. 4,482,184 provides a parallelogram structure that folds in on itself, allowing the chair to be folded up when not in use, and provides telescoping, tubular side structures that allow the chair to be folded up, but which act as support structures when the chair is expanded and used. However, there are a number of problems and deficiencies associated with that chair. One major problem has been that when one is seated on the chair, the chair tends to collapse in on itself if the person leans too-far forward. That is, the shifted weight of the seated person forces the chair into its folded-up position, which the user himself must overcome by providing counteracting moments, which is very uncomfortable. Moreover, if there are not provided the necessary counteracting moments, the chair will collapse, thus potentially injuring, or at least embarrassing, the person.

An additional problem with the chair disclosed in U.S. Pat. No. 4,482,184 is that only after a relatively short period of use, sand and dirt enter into the interior tubing of the telescoping side structures, and into the ball-bearing support of the swivel-mount that allows the chair to swivel. The sand and dirt clog up the interior of the outer tubular elements, preventing the inner telescoping tubular elements from sliding within the outer tubular elements, and prevent, or at least hinder, the upper swivel plate's rotation on the ball bearings. Without the necessary sliding movement between the outer and inner tubular elements of the telescoping side structures, the chair cannot be folded if in an erected state, and cannot be erected if in a folded state, since the relative sliding movement of the inner and outer tubular elements of the telescoping tubular side structures is essential to the proper erection and folding of the chair, and without easy rotational movement of the upper swivel plate, the chair is difficult to swivel.

An additional problem with the chair disclosed in U.S. Pat. No. 4,482,184 is that the chair does not completely collapse or fold. That is, the arm supports of the chair, which are vertically oriented when the chair is in its erected state, do not lie horizontally flush with the base of the chair when the chair is folded. Thus, the folded chair is more bulky and more difficult to carry and transport.

Still another problem with the chair disclosed in U.S. Pat. No. 4,482,184 is that the rear pivot pin of that chair tends to bend over time because of undue stress at its ends.

SUMMARY OF THE INVENTION

It is, therefore, the primary objective to provide a portable folding chair similar to the one disclosed in U.S. Pat. No. 4,482,184 but which overcomes the above-mentioned drawbacks and problems associated with that chair.

The portable folding chair of the invention overcomes the above-mentioned problem of the erected chair of U.S. Pat. No. 4,482,184 tending to collapse, by providing a manually releasable, spring-biassed detent ball, or pin, for each of the telescoping tubular side structures. The inner tubular element of each telescoping tubular side structure is provided with an outwardly-biassed locking pin which mates or fits into associated holes or openings formed in portions of the outer and inner tubular elements of the telescoping tubular side structure. When the chair is erected, with the inner tubular element sliding into the interior of the outer tubular element, the pin will be received through the opening in the outer tubular element. The pin acts as a detent that prevents the two tubular elements from sliding relative to each other, so that it is impossible for the chair to collapse, even with the weight of the person seated thereon shifted forwardly. When it is desired to collapse the chair, the pins are, simply, manually pushed in beyond the holes, thus allowing the inner and outer tubular elements to slide relative to each other, and to, thus, allow for the collapse of the chair.

The chair of the invention has solved the second problem mentioned above with regard to sand entering into the interior of the tubing of the telescoping side structures by inverting the orientation of the inner and outer tubular elements thereof, whereby the outer, larger-diameter tubular element is positioned as the upper element pivotally connected to the upper part of the arm support, and whereby the inner, smaller-diameter tubular element is the lower element pivotally connected to the lower seat rail. By this inversion, the annular gap, or opening, between the outer and inner tubular elements faces downwardly, so that any sand that enters therethrough will fall right out again by gravity, in contradistinction to the construction in the chair disclosed in U.S. Pat. No. 4,482,184, where sand entering into the annular gap from above is pulled down into the interior of the outer tubular element by gravity. With regard to sand or dirt entering into the swivel-mount's ball-bearing support, the invention solve this problem by the provision of a foam ring that surrounds the annular gap between the upper and lower swivel-plates which sandwich therebetween the ball bearings.

The chair of the invention has solved the third problem mentioned above, with regard to the fact that the chair of U.S. Pat. No. 4,482,184 does not completely collapse or fold, by skewing the two, front upright arm supports forwardly such that each makes an acute angle with respect to the vertical.

The last-mentioned problem above has been solved by pivotally mounting the rear U-shaped tubular structure to the ends of the rear pivot pins that pivotally mount the lower ends of the telescoping members to the seat rails.

BRIEF DESCRIPTION OF THE DRAWING

The invention will be more readily understood with reference to the accompanying drawing, wherein.

DETAILED DESCRIPTION OF THE INVENTION

Figure 1:
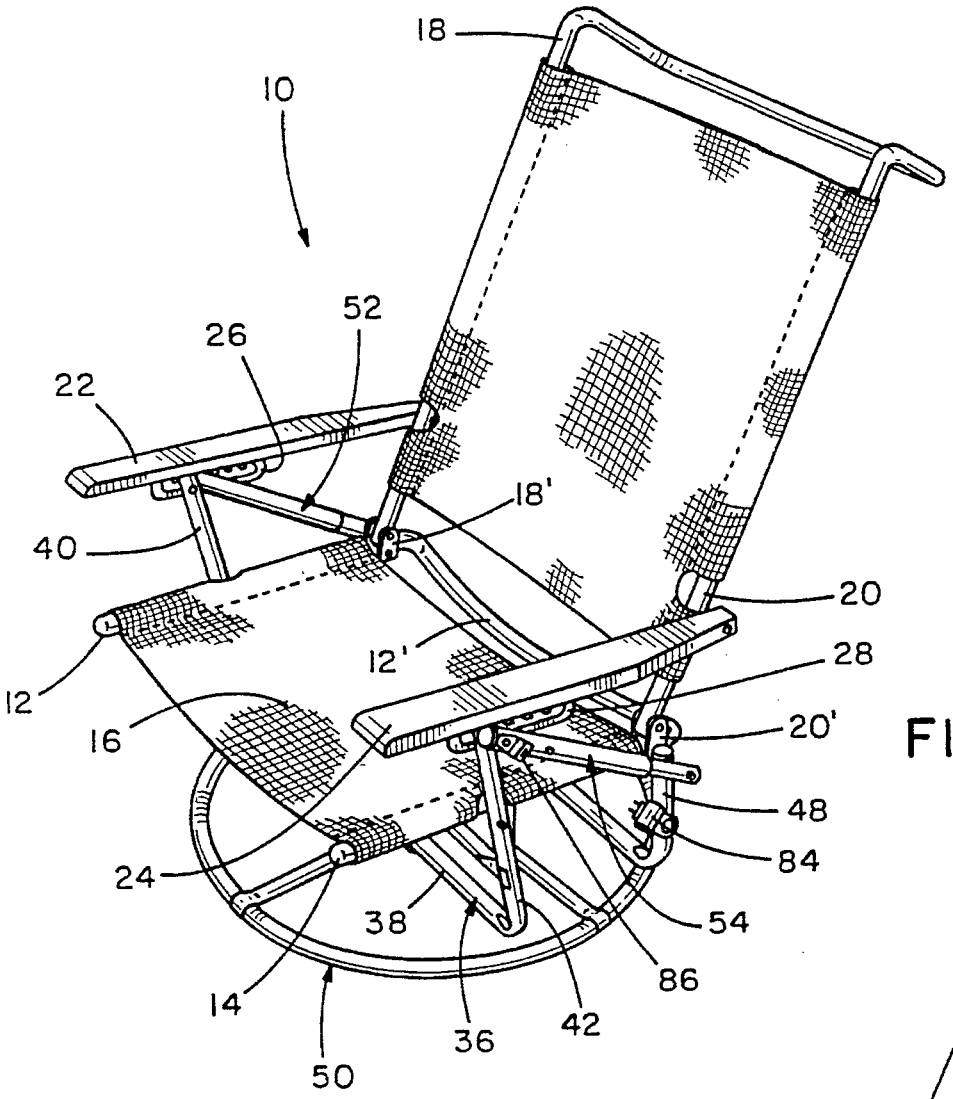
FIG. 1 is an isometric view of the portable folding chair of the invention.
Figure 2:
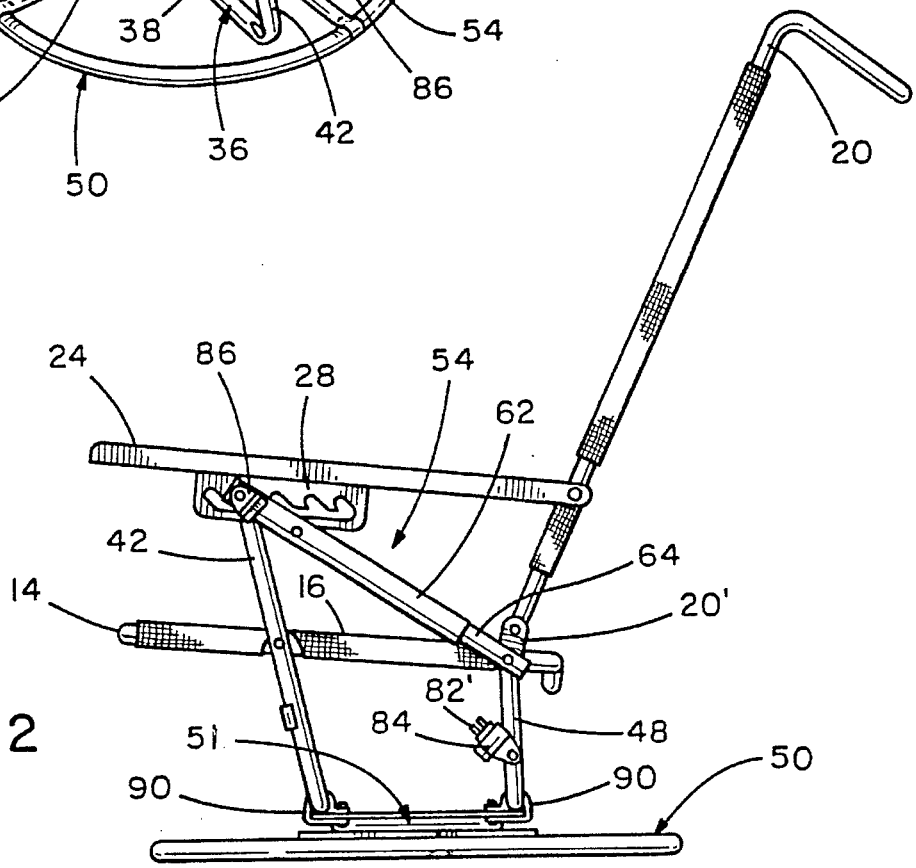
FIG. 2 is a side elevational view thereof.

Referring now to the drawings in greater detail, where like reference numerals indicate like parts, the portable folding chair of the invention is indicated generally by reference numeral 10. The chair 10 is an improvement on the portable folding chair disclosed in U.S. Pat. No. 4,482,184—Mincey, which patent is incorporated by reference herein. Like the portable folding chair disclosed in U.S. Pat. No. 4,482,184, the chair 10 of the present invention has a pair of horizontal, seat-supporting, cylindrical tubes 12, 14 to which are connected or mounted suitable material upon which a person may sit when the chair 10 is in its erected position, the suitable material thus constituting the seat proper 16 of the chair 10. The tubes 12, 14 form part of a U-shaped element, which U-shaped element is completed by a rear, horizontal tube 12'. Projecting upwardly from the rear of the seat-supporting tubes 12, 14 are a pair of vertical, back-supporting tubes or rails 18, 20 which together support suitable material for providing the seat-back of the chair. The tubes 18, 20 are secured to the rear of the tubes 12, 14, respectively, U-shaped pivot clamps 18', 20', which allow the seat-back tubes 18 and 20 to pivot forwardly or rearwardly. A short way up along each vertical tube 18, 20, there is pivotally mounted the rear end-portion of an arm-rest 22, 24, respectively. Mounted to the underside of each arm-rest 22, 24 is an adjustment bracket 26, 28, respectively, by means of which the seat-back tubes may be vertically adjusted to change the slope of the seat-back.

Figure 3:
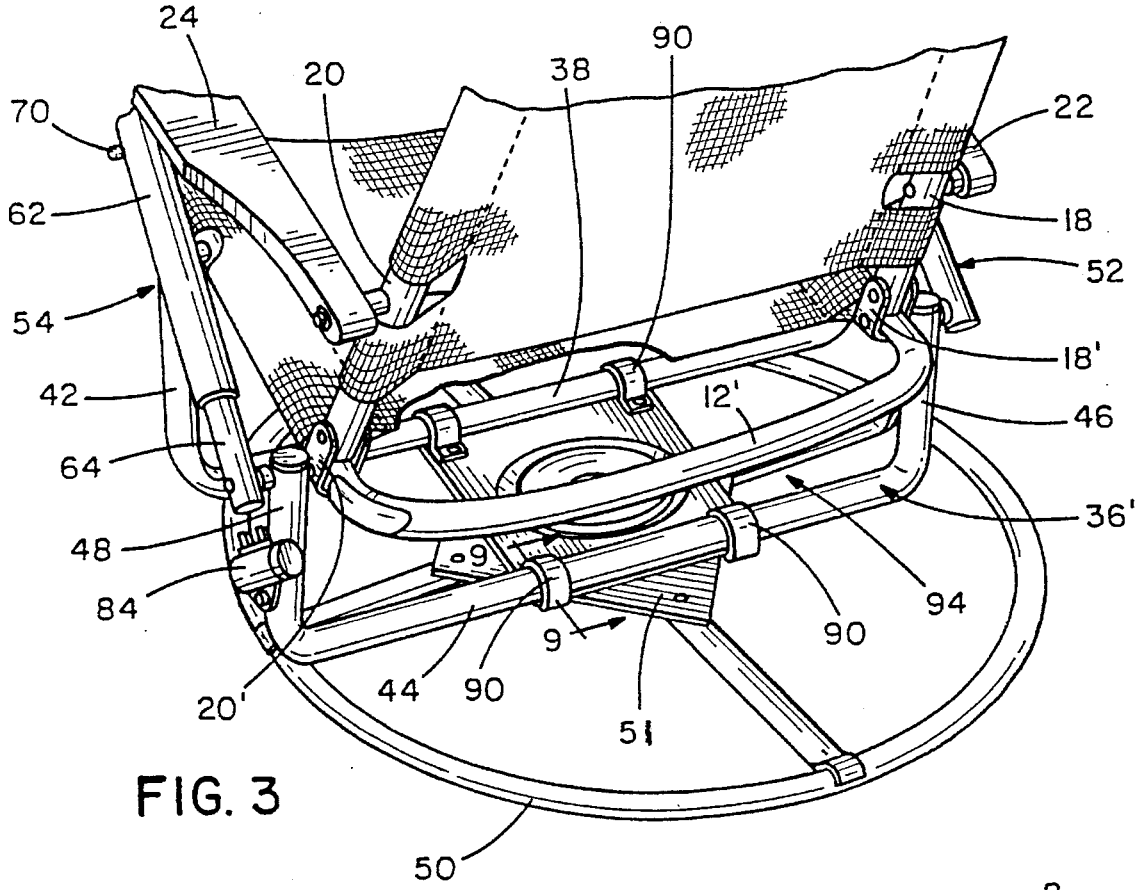
FIG. 3 is a rear isometric view thereof.
Figure 4:
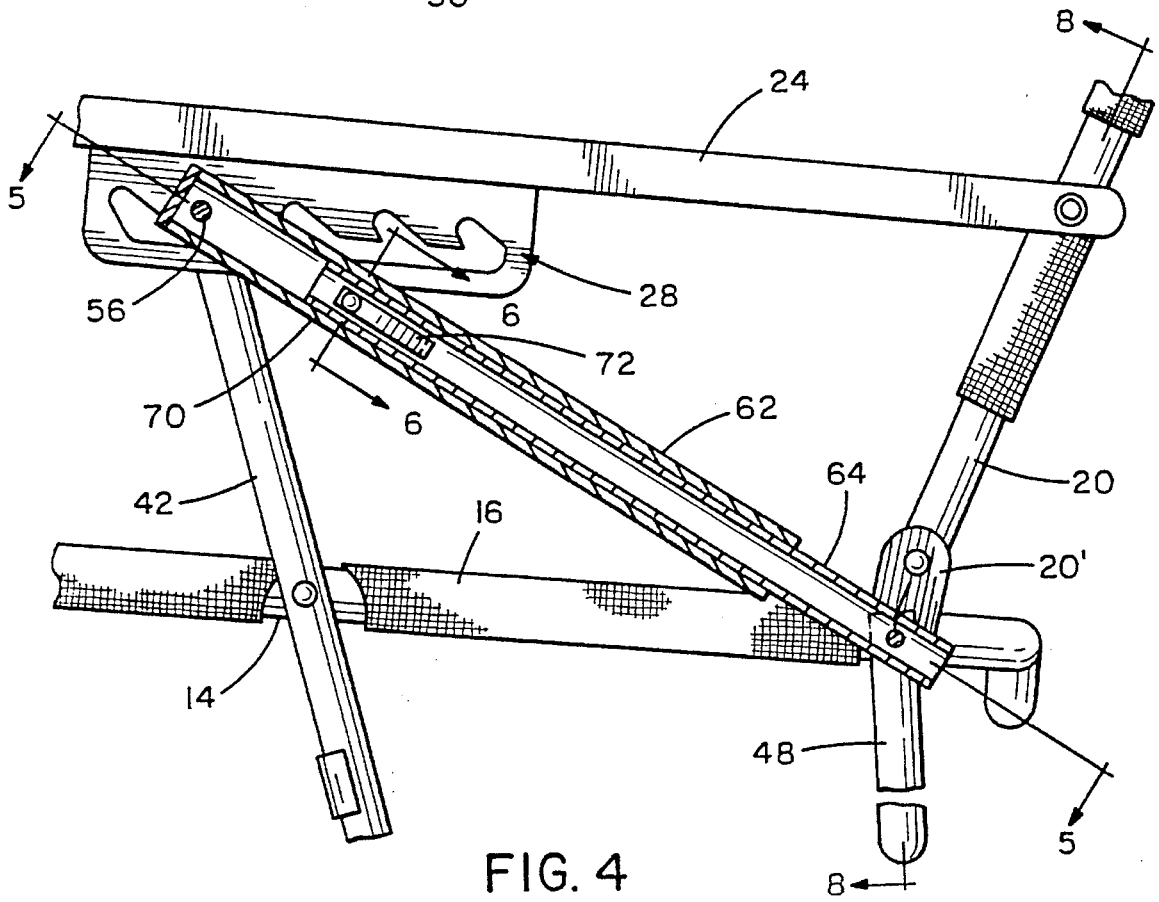
FIG. 4 is a detail side view thereof.

The chair is supported on a support surface by means of a front, U-shaped support structure 36 and a rear, U-shaped structure 36'. The front, U-shaped support structure 36 is made up of a lower horizontal tube 38, and a pair of end-tubes 40, 42. A middle section of each end-tube 40, 42 is pivotally connected to a section of the horizontal, seat-supporting, cylindrical tubes 12, 14, respectively. The upper ends of the end-tubes 40, 42 are engaged with the adjustment brackets 26, 28, respectively, by means of a pin, described hereinbelow. The rear, U-shaped structure 36' has a lower, horizontal tube or rail 44, and a pair of vertically-oriented end-tubes 46, 48, projecting from the ends of the tube 44, as best seen in FIG. 3. The upper ends of the vertically-oriented tubes 46, 48 are pivotally coupled to the rear end portions of the horizontal, seat-supporting, cylindrical tubes 12, 14, respectively, at the location where the U-shaped pivot clamps 18', 20' are located The front and rear U-shaped support structures 36, 38 may be mounted on a circular base 50 with a swivel mount 51, as disclosed in U.S. Pat. No. 4,482,184—Mincey.

Figure 5:
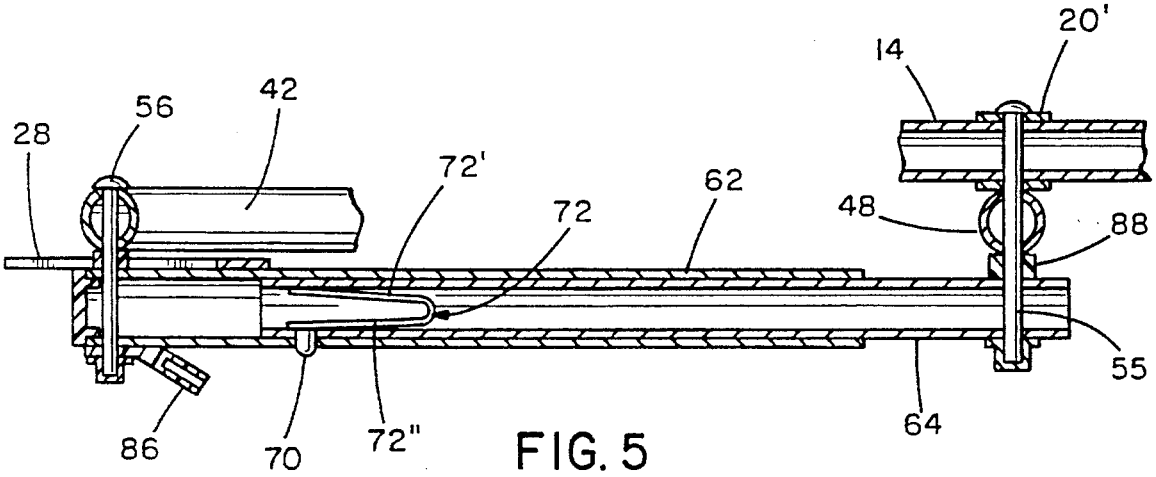
FIG. 5 is a cross-sectional view taken along line 5—5 of FIG. 4.
Figure 6:
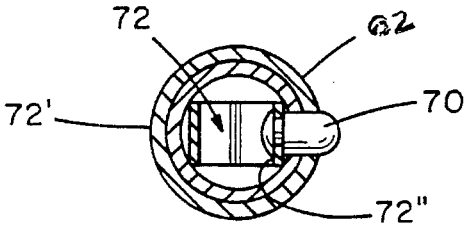
FIG. 6 is a cross-sectional view taken along line 6—6 of FIG. 4.
Figure 7:
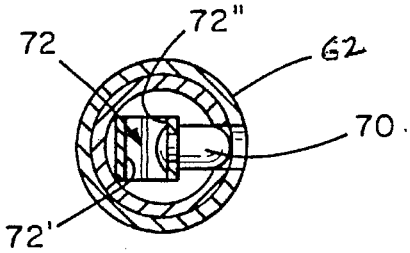
FIG. 7 is a view similar to FIG. 6 but showing the detent in its retracted position to allow for the collapse of the chair.
Figure 8:
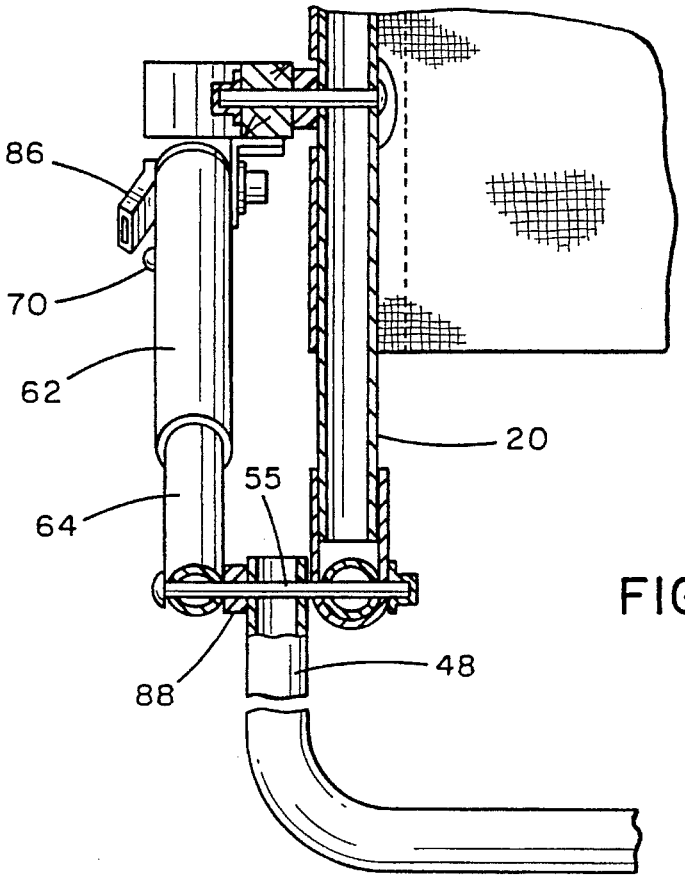
FIG. 8 is a cross-sectional view taken along line 5—5 of FIG. 4.
Figure 10:
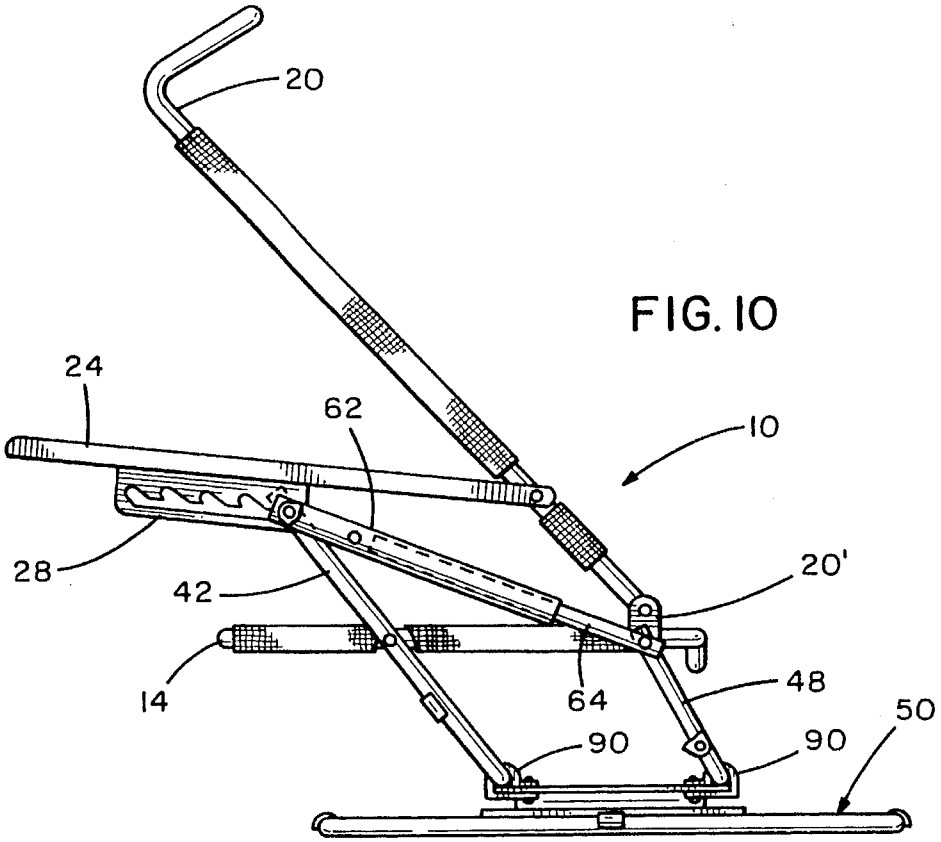
FIG. 10 is a side elevational view similar to FIG. 2 but showing the chair at the start of collapsing the chair.

Connecting the upper ends of front end-tubes 40, 42 to the upper ends of the rear, vertically-oriented end-tubes 46, 48 are a pair of telescoping, members 52, 54. The upper end of each telescoping member 52, 54 is pivotally connected to the upper end of an end-tube 40, 42, respectively, by means of a pivot pin or rod 56, which pivot pin is received within a chosen recess of an adjustment bracket 26, 28, respectively, as best seen in FIG. 5, whereby the upper end of the respective telescoping member 52, 54 and the upper end of the respective end-tube 40, 42 sandwich therebetween a respective adjustment-bracket 26, 28. By pivoting up the arm-rests 22, 24, the pivot pins 56 are disengaged, allowing the seat-back to be inclined or declined, upon which, the pins 56 are then re-engaged in a different notch or recess of each adjustment bracket 26, 28. The lower end of each telescoping member 52, 54 is pivotally connected by a pivot pin 55 to an upper end section of a rear vertical tube 46 or 48, respectively, which pivot pin 55 also extends through the respective tube 46 or 48 and through a respective U-shaped pivot clamps 18', 20 that allow the seat-back tubes 18 and 20 to pivot forwardly or rearwardly, in order to pivotally mount the tubes 12, 14, that, together with the rear, horizontal tube 12', form part of the U-shaped element upon which the seat-proper material is mounted.

The above-description is, for all intents and purposes, also describes the chair disclosed in U.S. Pat. No. 4,482,184. The chair 10 of the invention is an improvement over the chair disclosed in U.S. Pat. No. 4,482,184 in the following way.

In the chair of U.S. Pat. No. 4,482,184, the telescoping members are arranged such that the larger-diameter, outer tube is located below, with the small-diameter, inner tube located above. In the chair 10 of the invention, the tubes are reversed. Thus, each telescoping member 52, 54 has a larger-diameter, outer tube 62 located on the top when the chair is in its erected state, and a smaller-diameter, inner tube 64 located below, as seen in FIGS. 2, 4, 5, and 8. The advantage to having each telescoping member arranged this way, is that when the chair 10 is used as a beach chair and supported on sand and dirt, any particles of sand and dirt that are blown into the interior of the telescoping members via the annular gap between the inner and outer tubes, will simply fall right out again by gravity. In U.S. Pat. No. 4,482,184, the sand enters into the interior of the telescoping members also by the annular gap between the inner and outer tubes; however, since this annular gap faces upwardly, the sand and dirt enters into the interior by falling from above. In that case, gravity only serves to cause more accumulation of sand in the interior, causing the two telescoping tubes to lock, preventing their extension or contraction relative to each other, and, thus, preventing, over time, the opening and collapsing of the chair. In contradistinction, in the chair 10 of the invention, gravity acts to cause the sand to fall out from the interior of the telescoping members, thus preventing any accumulation of sand and dirt in the interior of the telescoping members, and, thus, preventing the inner and outer tubes from locking.

Another problem that the chair 10 of the invention has solved vis-a-vis the chair of U.S. Pat. No. 4,482,184 is the one directed to the tendency of the collapsing of the chair of U.S. Pat. No. 4,482,184 whenever a person sits on the chair in its erected position. Upon sitting on the chair of U.S. Pat. No. 4,482,184, the act of leaning or sitting forwardly causes the telescoping members thereof to extend, moving the inner and outer telescoping tubes outwardly from each other, which is the action they take when the chair is folded into its collapsed state. Since all of the rails or tubes of the chair are pivotally connected together, the elongation of the telescoping members upon a person being leaning forwardly on the chair causes the entire chair to try and fold up into its collapsed state. This is not only uncomfortable to the user of the chair, but also potentially dangerous to the user. The chair 10 has overcome that problem by the provision of a retractable locking pin or snap button 70 in each of the telescoping members 52, 54, as best seen in FIGS. 4–7. Each locking pin or snap button 70 is biassed outwardly by means of a U-shaped compression spring 72 having a leg 72' fixedly mounted to an upper, interior portion of the lower, inner-diameter tube 64, whereby its free leg 72" with the locking detent attached thereto is biassed outwardly. Each of the inner and outer tubes 62, 64 has an opening through which the locking pin 70 protrudes. These openings in the inner and outer tubes are in linear alignment with each other when the chair 10 is in its completely erected state. Whenever the chair is erected for use, the openings become automatically aligned as the chair is unfolded, with the locking pins protruding through the openings of the outer tubes, to thus lock the chair 10 in its erected position, whereby, as a person sits thereon, there is no tendency for the chair to fold up when he leans or shifts forwardly. When it is desired to fold up or collapse the chair, one simply pushes in on each locking pin 70 until the locking pin is pushed behind the opening of the outer tube, whereupon the outer tube is extended relative to the inner tube, for folding and collapsing the chair. Since the inner and outer tubes are prevented from having rotation relative to each other because of the connections of the ends of the telescoping members 52, 54 to other, respective tubes or rails of the chair 10, when the chair is again unfolded and erected, each locking detent automatically pops into place through an opening formed in the respective outer tube.

Figure 11:
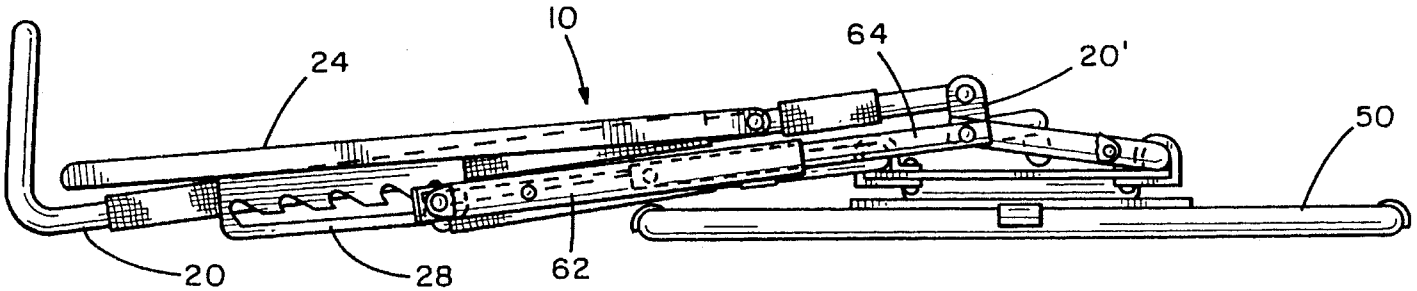
FIG. 11 is a side view showing the chair in its totally collapsed state.

Another improvement of the chair 10 over that disclosed in U.S. Pat. No. 4,482,184, is that the pair of end-tubes 40, 42 of the front U-shaped structure is slanted or tilted forwardly, and makes an acute angle with respect to the vertical when the chair is erected. This acute angle, in the preferred embodiment, is between 5–15 degrees. Because the telescoping members 52, 54 are provided with detents that prevent their extension when the chair is erected, those same detents allow for these end-tubes 40, 42 to be forwardly sloped without the consequent worry of the chair collapsing due to these forwardly-sloping end-tubes. In the chair disclosed in U.S. Pat. No. 4,482,184, these tubes are completely vertical when the chair is erected. Thus, when that chair is folded, it is impossible to completely collapse that chair such that all of the tubes or rails lie in close juxtapositional contact against each other and in parallel orientation relative to each other. Thus, the chair of U.S. Pat. No. 4,482,184, in its folded state, is still very bulky and awkward to carry. In contrast, the chair 10 folds to a completely collapsed state, as seen in FIGS. 11 and 12, where the tubes or rails are in contact and parallel with each other, allowing for a more compact and more easily carried chair.

Figure 12:
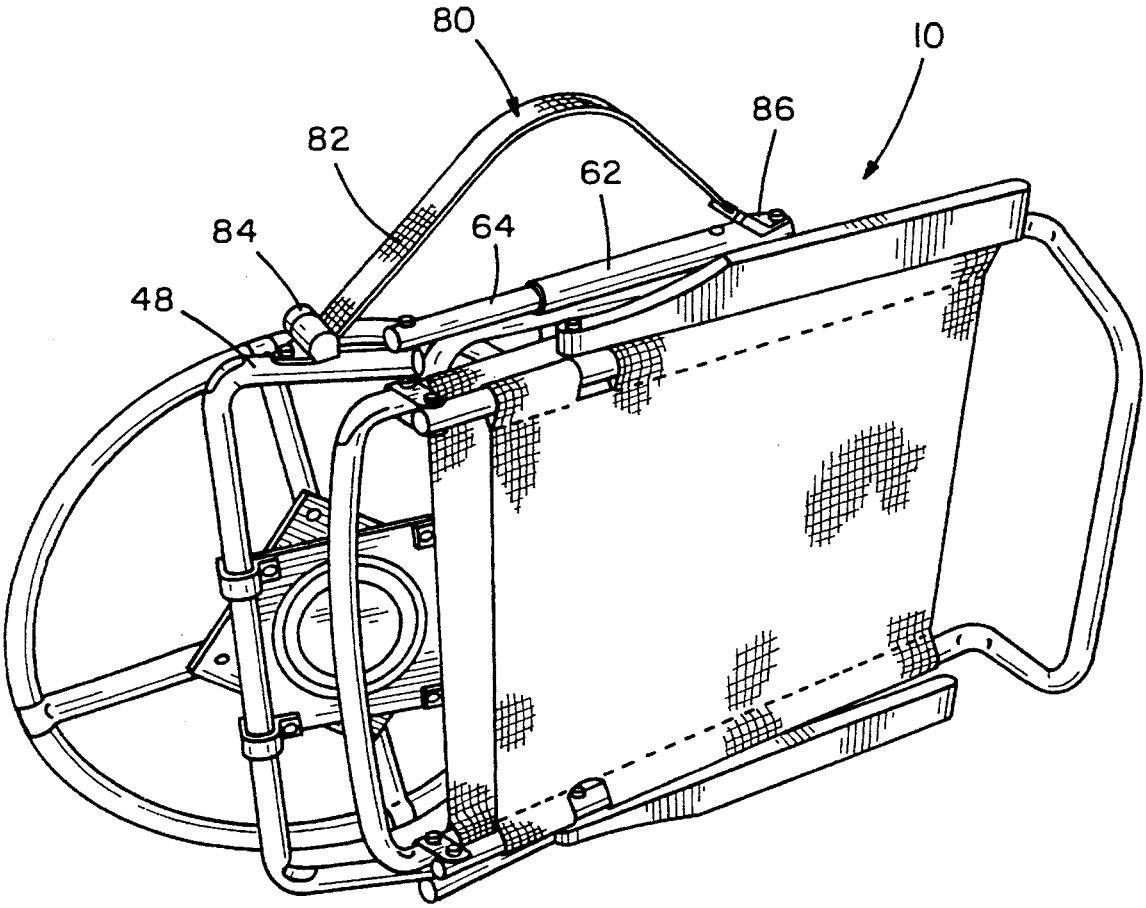
FIG. 12 is an isometric view showing the chair in its collapsed state and ready for carrying by means of a retractable shoulder strap thereof.
Figure 13:
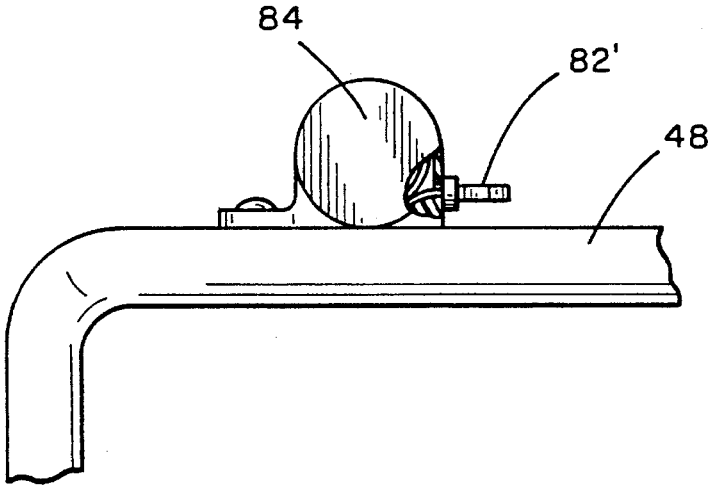
FIG. 13 is an enlarged detail view showing the housing for the retractable carrying strap mounted on a rear vertical leg of the chair.

The chair 10 is also provided with a retractable carrying or shoulder strap assembly 80, as seen in FIG. 12. The retractable carrying or shoulder strap assembly 80 consists of a strap 82 that is stored in a rolled-up condition in a circular, dispensing housing 84 (FIGS. 1, 3, 12 and 13) mounted to a lower, exterior-facing section of the rear vertical tube 48. The housing 84 is conventional, and spring-loads the shoulder strap proper 82, so that, upon release, it automatically coils up inside the housing. The shoulder strap 82 has a free end 82' that is prevented from entering into the housing, which free end is received in a latch-receptor 86 mounted to an upper, exterior section of the telescoping member 54. When it is desired to use the shoulder strap, the free end 82' is grasped and pulled to extend the shoulder strap by unwinding it from its housing 84, until enough has been extracted in order to insert the free end 82' into its receptor 86, as seen in FIG. 12. It is, of course, possible to provide the shoulder strap assembly 80 on different elements or tubes of the chair 10, if so desired.

The chair 10 is, also, different from the chair disclosed in U.S. Pat. No. 4,482,184, in the location of the rear U-shaped structure 36'. In the patented chair, the rear U-shaped structure is pivotally connected at one upper ends of the vertical end-tubes thereof to middle portions of the seat rail or tubes. Thus, those vertical end-tubes are spaced considerably from the rear pivot pin 56 of that chair. Thus, in the chair of U.S. Pat. No. 4,482,184, the sections of that pivot pins between the lower ends of a telescoping members and the associated, juxtapositioned upper ends of the vertical end-tubes are prone to bending because of the undue stress experienced when a person is seated. This problem has been solved in the chair 10 of the invention by moving the rear, U-shaped structure 36' rearwardly all the way back to the pivotal connection of the telescoping members 52, 54 with the pair of horizontal, seat-supporting, cylindrical tubes 12, 14 to which are connected or mounted the seat proper. As seen in FIG. 3, the vertical tubes 46, 48 are connected at their upper ends between the lower ends of the telescoping members 52, 54, respectively, and the seat-mounting tubes 12, 14, respectively, with the pivot pins 55 passing also therethrough, with a washers 88 spacing the upper ends of the tubes from the lower ends of the telescoping members. This arrangement is an advantage over that of the chair of U.S. Pat. No. 4,482,184. Firstly, it provides greater structural support and strengthen the pivot pins 55 at just the location where they experience the greatest stress when a person is seated in the chair. In the chair of U.S. Pat. No. 4,482,184, the section of the pivot between the lower end of a telescoping member and the associated, juxtapositioned upper end of the vertical tube is prone to bending because of the undue stress experienced when a person is seated. Secondly, the chair 10 is more stable and less prone to be tipped over because of the greater spacing between the front and rear U-shaped tubular structures 36, 36'.

Figure 9:
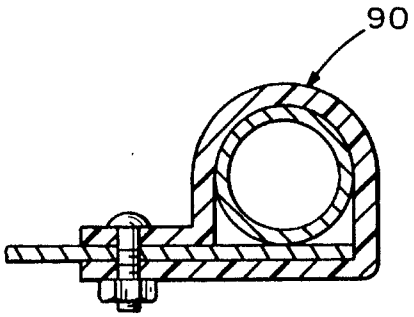
FIG. 9 is a cross-sectional view showing the mounting of the front and rear lower rail or tube.

Another advantage of the chair 10 over that of U.S. Pat. No. 4,482,184 lies in the material used for the clamps 90 used to mount the lower horizontal rails or tubes 38 and 44 to the swivel mount 51 of the base 50, which clamps 90 are best seen in FIGS. 3 and 9. In the patented chair, those clamps are made of aluminum. However, since the chair commonly supported on sand or dirt, the particles of sand or dirt accumulate between the contacting surfaces of the clamp and tubes of the chair, which, over time, prevent the tubes from rotating within the clamps when the chair is to be folded up or unfolded for use. The chair 10 solves that problem by making the clamps 90 not of aluminum but of plastic. In the preferred embodiment, the clamps 90 are made of nylon 6/6, which, according to a prototype of the chair 10, has completely solved the problem. Thermoplastic resin materials may also be used instead of nylon.

Also, in order to prevent the clamps 90 from sliding along the tubes 38, 44, which thereby causes the seat to shift and cause instability with the risk of tipping over, a pair of projections or dimples 94 are provided on the upper surface of the rear horizontal tube 44, as best seen in FIG. 3. Each projection 44 lies on exterior side of the closely adjacent clamp 90, in order to prevent any lateral shift of the clamps along the tube 44.

Figure 14:
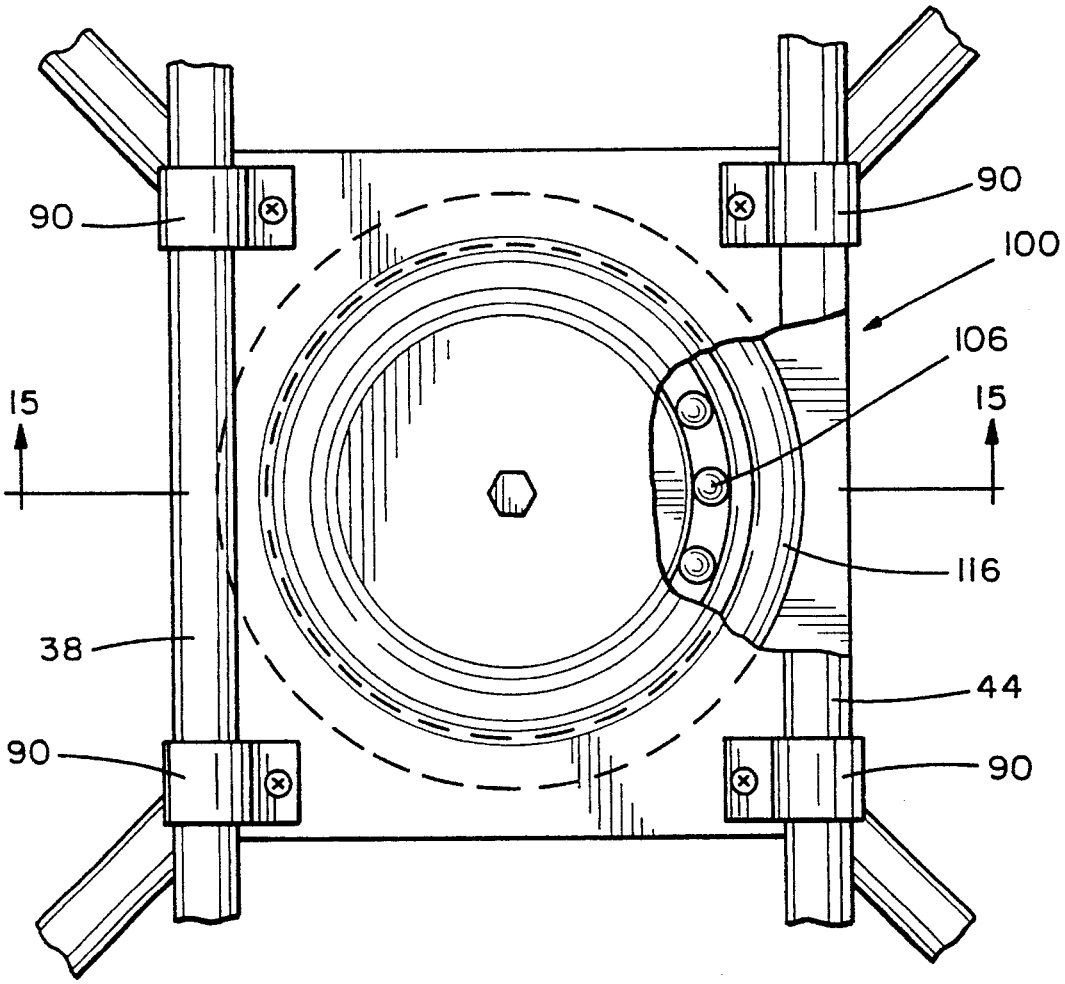
FIG. 14 a top view, partially broken away, showing the swivel-mount of the chair with an annular, protective, foam ring for preventing sand and dirt from entering into the ball-bearing support area.
Figure 15:
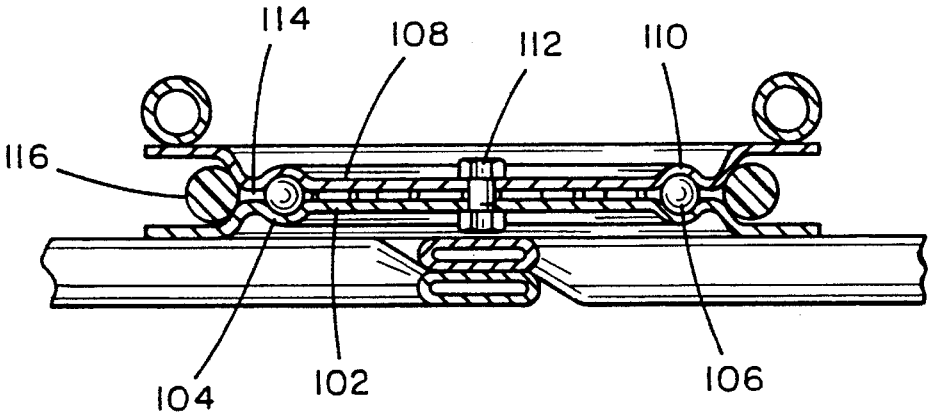
FIG. 15 is a cross-sectional view taken along line 15—15 of FIG. 14.

Referring now to FIGS. 14 and 15, there is shown the swivel-mounting assembly 100 of the chair. Like the swivel-mounting assembly disclosed in U.S. Pat. No. 4,482,184, the swivel-mounting assembly 100 has a lower support plate 102 provided with a circular recess, or race, 104 in which are located a series of ball bearings 106. An upper swivel-plate 108 is rotatably mounted on the lower support plate by means of a central pivot shaft 112 and the ball bearings 106, which ball bearings are also received, or seated, in a circular recess, or race, 110 formed in the swivel-plate 108, as best seen in FIG. 15, which race 110 is coextensive with the lower race 104. As can be seen in FIG. 15, the upper and lower plates 102, 108 form an annular gap 114 therebetween, through which annular gap it is possible for sand or dirt to enter into the interior of the swivel-mounting assembly. Sand or dirt in the interior of the swivel-mounting assembly will adversely affect the ball bearings and the rotational movement of the upper plate 108 relative to the lower plate. The dirt and sand not only increases the dynamic friction between the ball bearing 106 and the race 110, but also may physically damage the ball bearings themselves, such that they are no longer perfectly spherical, which also impedes, or may even prevent, the rotation of the upper swivel-plate 108.

In accordance with the present invention, there is provided an annular foam ring 116 that completely covers or closes off the annular gap 114, so that substantially no sand, dirt, or other foreign particles are allowed to enter into the interior of the swivel-mounting assembly. The annular foam ring must be of a material that provides reduced dynamic and static frictional contact, since the annular foam ring is in abutting contact with surface-portions of the upper swivel-plate 108, as seen in FIG. 15. If the foam ring were made of a material having a high coefficient of static or dynamic friction, then the rotation of the upper swivel-plate 108 would be impaired. In the preferred embodiment, the foam ring 116 is made of polyethelene foam manufactured by Hercules Corp. of Canada, having a density of 2 lbs./foot, a tensile strength of 25 psi, water absorption of 0.5% by volume, and a compression of 25% @ 8 psi. This material has been found to offer practically no resistance to the rotation movement of the upper swivel-plate.

While a specific embodiment of the invention has been shown and described, it is to be understood that numerous changes and modifications may be made therein without departing from the scope spirit and intent of the invention as set forth in the appended claims.

What I claim is:

1. In a swivel chair comprising a seat, and a supporting structure for supporting said seat on a surface, said supporting structure comprising a swivel-mounting assembly by which said seat may be rotated relative said supporting structure; said swivel-mounting assembly comprising a lower support plate, and an upper swivel-plate, and bearing means for rotatably mounting said upper swivel-plate to the said lower support plate; said lower support plate and said upper swivel plate defining an annular gap therebetween cooperating with the interior of said swivel-mounting assembly, wherein the improvement comprises:

said swivel-mounting assembly further comprising an annular foam ring exteriorly surrounding said annular gap, said annular foam ring at least being in partial surface-to-surface contact with a portion of said upper swivel-plate; said annular foam ring being made of a material having a low coefficient of static and dynamic friction, whereby said annular foam ring prevents foreign particles from entering into the interior of said swivel-mounting assembly without impeding the rotational movement of said upper swivel-plate.

2. The chair according to claim 1, wherein said annular foam ring is made of polyethelene foam having a density of 2 lbs./foot, a tensile strength of 25 psi, water absorption of 0.5% by volume, and a compression of 25% @8 psi.

3. The chair according to claim 1, wherein said bearing means comprises ball bearings.

* * * * *